US010255849B2

(12) United States Patent
Ma

(10) Patent No.: US 10,255,849 B2
(45) Date of Patent: Apr. 9, 2019

(54) PIXEL CIRCUIT, METHOD FOR DRIVING PIXEL CIRCUIT AND DISPLAY APPARATUS

(71) Applicant: BOE TECHNOLOGY GROUP CO., LTD., Beijing (CN)

(72) Inventor: Zhanjie Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 302 days.

(21) Appl. No.: 14/443,951

(22) PCT Filed: Sep. 24, 2014

(86) PCT No.: PCT/CN2014/087316
§ 371 (c)(1),
(2) Date: May 19, 2015

(87) PCT Pub. No.: WO2015/196603
PCT Pub. Date: Dec. 30, 2015

(65) Prior Publication Data

US 2016/0253958 A1 Sep. 1, 2016

(30) Foreign Application Priority Data

Jun. 25, 2014 (CN) ..... 2014 1 0293096

(51) Int. Cl.
*G09G 3/3233* (2016.01)
*G09G 3/3225* (2016.01)

(52) U.S. Cl.
CPC ..... *G09G 3/3225* (2013.01); *G09G 3/3233* (2013.01); *G09G 2300/0819* (2013.01);
(Continued)

(58) Field of Classification Search
CPC .. G09G 3/3208; G09G 3/3225–3/3258; G09G 3210/0243; G09G 3210/061; G09G 3210/0245
See application file for complete search history.

(56) References Cited

U.S. PATENT DOCUMENTS

2005/0243586 A1 11/2005 Chung et al.
2007/0279337 A1 12/2007 Kim et al.
(Continued)

FOREIGN PATENT DOCUMENTS

CN 101471032 A 7/2009
CN 101520986 A 9/2009
(Continued)

OTHER PUBLICATIONS

Second Office Action regarding Chinese application No. 201410293096.5, dated May 11, 2016. Translation provided by Dragon Intellectual Property Law Firm.
(Continued)

*Primary Examiner* — William Boddie
*Assistant Examiner* — Jeffrey Parker
(74) *Attorney, Agent, or Firm* — Harness, Dickey & Pierce, P.L.C.

(57) ABSTRACT

A pixel circuit comprises: a reset unit, configured to input a reset voltage into the gate electrode of the driving transistor to reset the driving transistor; a writing unit, configured to write a data voltage into a second end of the storage capacitor and write a reference voltage into a second electrode of the driving transistor; a threshold voltage latching unit, configured to enable a connection between the gate electrode of the driving transistor and the first electrode of the driving transistor; a driving level latching unit, configured to latch a second driving level to the second end of the storage capacitor and a light-emitting control unit, configured to input the second driving level into the second electrode of the driving transistor, and compensate for the threshold voltage of the driving transistor and the second driving level by a gate-source voltage of the driving transistor.

12 Claims, 2 Drawing Sheets

(52) U.S. Cl.
CPC ..... *G09G 2300/0842* (2013.01); *G09G 2300/0861* (2013.01); *G09G 2310/0243* (2013.01)

(56) References Cited

U.S. PATENT DOCUMENTS

| | | | | |
|---|---|---|---|---|
| 2009/0073095 | A1 | 3/2009 | Uchino et al. | |
| 2009/0201231 | A1* | 8/2009 | Takahara | G09G 3/3233 345/76 |
| 2013/0088474 | A1* | 4/2013 | Wang | G09G 3/3258 345/211 |
| 2014/0111503 | A1 | 4/2014 | Kwon et al. | |
| 2016/0155383 | A1 | 6/2016 | Chen | |

FOREIGN PATENT DOCUMENTS

| | | | |
|---|---|---|---|
| CN | 101763819 | A | 6/2010 |
| CN | 102349098 | A | 2/2012 |
| CN | 102682704 | A | 9/2012 |
| CN | 103021333 | A | 4/2013 |
| CN | 103021336 | A | 4/2013 |
| CN | 103474024 | A | 12/2013 |

OTHER PUBLICATIONS

First Office Action regarding Chinese application No. 201410293096.5, dated Oct. 10, 2015. Translation provided by Dragon Intellectual Property Law Firm.

Written Opinion of the International Searching Authority for international application No. PCT/CN2014/087316 dated Mar. 30, 2015; 13 pages.

Park, Y. et al., "A New Voltage Driven Pixel Circuit for Large Sized AMOLED Panel", Department of Electronic and Electrical Engineering; IDW Tech. Dig.; Oct. 4, 2004; pp. 539-540.

Fan, C. et al., "An AMOLED AC-Biased Pixel Design Compensating the Threshold Voltage and I-R Drop", International Journal of Photoenergy, (vol. 2011, Article ID 543273); DOI: 10.1155/2011/543273; Sep. 1, 2011; pp. 393-403.

European Search Report regarding Application No. 14861099.1 dated Dec. 21, 2017.

* cited by examiner

PIXEL CIRCUIT, METHOD FOR DRIVING PIXEL CIRCUIT AND DISPLAY APPARATUS

CROSS-REFERENCE TO RELATED APPLICATIONS

The present application is the U.S. national phase of PCT Application No. PCT/CN2014/087316 filed on Sep. 24, 2014, which claims the priority of Chinese patent application No. 201410293096.5 filed on Jun. 25, 2014. The entire disclosures of both of the above applications are incorporated herein by reference.

TECHNICAL FIELD

The present disclosure relates to the technical field of display, and more particular to a pixel circuit, a method for driving the pixel circuit, and a display apparatus.

BACKGROUND

In a conventional pixel circuit implemented in an active matrix/organic light emitting diode (AMOLED) display apparatus, a driving level VDD and a voltage threshold Vth of a driving transistor are latched simultaneously. However, the driving transistor functions as a diode in the pixel circuit during a latching period, which is equivalent to charge an extra large resistance and a capacitor via a source electrode of the driving transistor, so that the charging of the capacitor is very slow, and a predetermined voltage may not be reached by fully charging during a predetermined period, while merely a particular voltage less than the predetermined voltage may be reached by charging. The ratio of the particular voltage and the predetermined voltage is called as a charging ratio, and thus the latched driving level should be multiplied by the charging ratio. As a result, the driving level VDD may not be totally compensated during a light-emitting period.

SUMMARY

An object of the present disclosure is to provide a pixel circuit, a method for driving the pixel circuit and a display apparatus so as to improve the compensation of the driving level.

For the above object, the present disclosure provides a pixel circuit including a driving transistor, a storage capacitor and a light-emitting device, wherein the driving transistor is connected to a first end of the light-emitting device, a first driving level is inputted to a second end of the light-emitting device, a first end of the storage capacitor is connected to a gate of the driving transistor; wherein the pixel circuit further includes:

a reset unit, configured to input a reset voltage into the gate electrode of the driving transistor to reset the driving transistor;

a writing unit, configured to write a data voltage into a second end of the storage capacitor and write a reference voltage into a second electrode of the driving transistor after the driving transistor is reset;

a threshold voltage latching unit, configured to enable a connection between the gate electrode of the driving transistor and the first electrode of the driving transistor after the driving transistor is reset, so as to latch a threshold voltage of the driving transistor to the gate electrode of the driving transistor;

a driving level latching unit, configured to latch a second driving level to the second end of the storage capacitor after the threshold voltage of the driving transistor is latched to the gate electrode of the driving transistor; and a light-emitting control unit, configured to input the second driving level into the second electrode of the driving transistor after the threshold voltage of the driving transistor is latched to the gate electrode of the driving transistor, so as to control the driving transistor to drive the light-emitting device to emit light, and compensate for the threshold voltage of the driving transistor and the second driving level by a gate-source voltage of the driving transistor.

In the implementation, the reset voltage is less than a sum of the reference voltage and the threshold voltage of the driving transistor.

In the implementation, the reset unit is controlled by a reset signal, both the writing unit and the threshold voltage latching unit are controlled by a scanning signal, and both the driving level latching unit and the light-emitting control unit are controlled by a light-emitting control signal.

In the implementation, the reset unit includes:

a reset transistor, wherein the reset control signal is inputted into a gate electrode of the reset transistor, wherein the reset voltage is inputted into a first electrode of the reset transistor, and wherein a second electrode of the reset transistor is connected to the gate electrode of the driving transistor.

In the implementation, the writing unit includes:

a data writing transistor, wherein the scanning signal is inputted into a gate electrode of the data writing transistor, wherein a first electrode of the data writing transistor is connected to the second end of the storage capacitor, and wherein the data voltage is inputted into a second electrode of the data writing transistor; and a reference voltage writing transistor, wherein the scanning signal is inputted into a gate electrode of the reference voltage writing transistor, wherein a first electrode of the reference voltage writing transistor is connected to the second electrode of the driving transistor, and wherein the reference voltage is inputted into a second electrode of the reference voltage writing transistor;

the threshold voltage latching unit includes a threshold voltage latching transistor, wherein the scanning signal is inputted into a gate electrode of the threshold voltage latching transistor, wherein a first electrode of the threshold voltage latching transistor is connected to the first electrode of the driving transistor, and wherein a second electrode of the threshold voltage latching transistor is connected to the gate electrode of the driving transistor.

In the implementation, the driving level latching unit includes a driving level latching transistor, wherein the light-emitting control signal is inputted into a gate electrode of the driving level latching transistor, wherein a first electrode of the driving level latching transistor is connected to the second end of the storage capacitance, and wherein the second driving level is inputted into a second electrode of the driving level latching transistor;

the light-emitting control unit includes a light-emitting control transistor, wherein the light-emitting control signal is inputted into a gate electrode of the light-emitting control transistor, wherein a first electrode of the light-emitting control transistor is connected to the second electrode of the driving transistor, and wherein the second driving level is inputted into a second electrode of the light-emitting control transistor.

The present disclosure further provides a method for driving the pixel circuit including:

inputting a reset voltage into a gate electrode of a driving transistor by a reset unit;

writing a data voltage into a second end of a storage capacitor and writing a reference voltage into a second electrode of the driving transistor by a writing unit;

enabling the connection between the gate electrode of the driving transistor and a first electrode of the driving transistor by a threshold voltage latching unit, so as to latch a threshold voltage of the driving transistor to the gate electrode of the driving transistor;

latching a second driving level to the second end of the storage capacitor by a driving level latching unit; and inputting the second driving level into the second electrode of the driving transistor by a light-emitting control unit, so as to control the driving transistor to drive the light-emitting device to emit light, and compensate for the threshold voltage of the driving transistor and the second driving level by a gate-source voltage of the driving transistor.

The present disclosure further provides a display apparatus including the above pixel circuit.

Optionally, the display apparatus is an AMOLED display apparatus.

As compared with the related art, the driving level and the threshold voltage of the driving transistor are latched asynchronously in the pixel circuit, the method for driving the pixel circuit and the display apparatus of the present disclosure, so that the driving level is maximally compensated and thus the compensation effect is improved.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments are merely a part of, rather than all of, the embodiments of the present disclosure, and based on these embodiments, a person skilled in the art may obtain the other embodiments, which also fall within the scope of the present disclosure.

The pixel circuit according to an embodiment of the present disclosure includes a driving transistor, a storage capacitor and a light-emitting device, the driving transistor is connected to a first end of the light-emitting device, a first driving level is inputted to a second end of the light-emitting device, a first end of the storage capacitor is connected to a gate electrode of the driving transistor; the pixel circuit further includes:

a reset unit configured to input a reset voltage into the gate electrode of the driving transistor to reset the driving transistor;

a writing unit configured to write a data voltage into a second end of the storage capacitor and write a reference voltage into a second electrode of the driving transistor after the reset of the driving transistor;

a threshold voltage latching unit, configure to enable a connection between the gate electrode of the driving transistor and the first electrode of the driving transistor after resetting the driving transistor, so as to latch a threshold voltage of the driving transistor to the gate electrode of the driving transistor;

a driving level latching unit, configured to latch a second driving level to the second end of the storage capacitor after the threshold voltage has been latched to the gate electrode of the driving transistor; and a light-emitting control unit, configured to input the second driving level into the second electrode of the driving transistor after the voltage threshold has been latched to the gate electrode of the driving transistor, so as to control the driving transistor to drive the light-emitting device to emit light, and the threshold voltage of the driving transistor and the second driving level are compensated by a gate-source voltage of the driving transistor.

In the pixel circuit according to the embodiment of the present disclosure, the driving level and the threshold voltage of the driving transistor are latched asynchronously, so that the driving level is maximally compensated and thus the compensation effect is improved.

Figure 1:
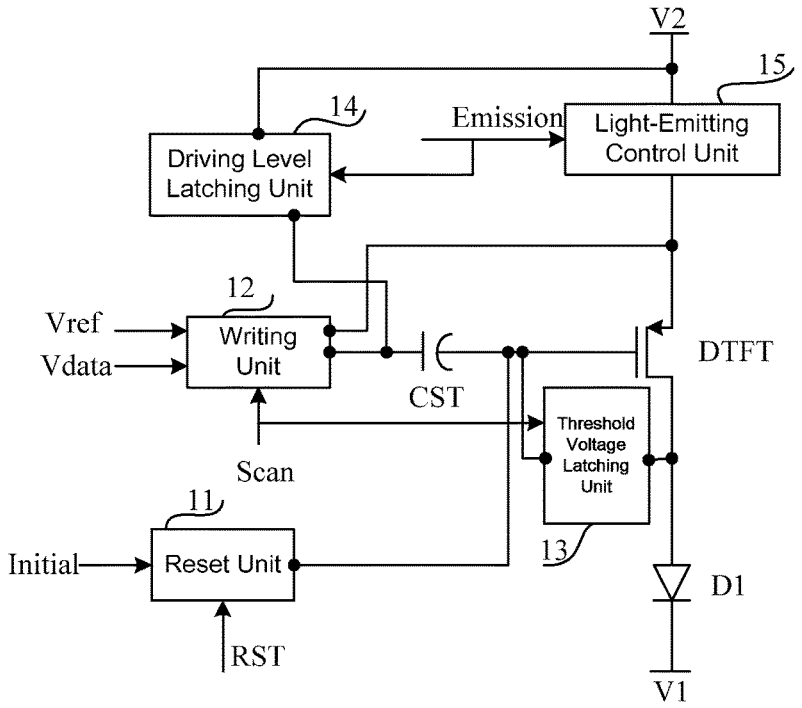
FIG. 1 is a schematic block diagram of a pixel circuit according to an embodiment of the present disclosure.

As illustrated in FIG. 1, the pixel circuit according to the embodiment of the present disclosure includes a driving transistor DTFT, a storage capacitor CST and a light-emitting device D1; the driving transistor DTFT is connected to a first end of the light-emitting device D1, a first driving level V1 is inputted to a second end of the light-emitting device D1, a first end of the storage capacitor CST is connected to a gate electrode of the driving transistor DTFT; the pixel circuit further includes:

a reset unit 11, being controlled by a reset control signal RST and configured to input a reset voltage Initial into the gate electrode of the driving transistor DTFT so as to reset the driving transistor DTFT;

a writing unit 12, being controlled by a scanning signal Scan and configured to write a data voltage Vdata into a second end of the storage capacitor CST and write a reference voltage Vref into a second electrode of the driving transistor DTFT after the reset of the driving transistor DTFT;

a threshold voltage latching unit 13, being controlled by the scanning signal Scan and configured to enable a connection between the gate electrode of the driving transistor DTFT and the first electrode of the driving transistor DTFT after the reset of the driving transistor DTFT, so as to latch a threshold voltage Vth of the driving transistor DTFT to the gate electrode of the driving transistor DTFT;

a driving level latching unit 14, being controlled by a light emitting control signal Emission and configured to latch a second driving level V2 to the second end of the storage capacitor CST after the threshold voltage Vth has been latched to the gate electrode of the driving transistor DTFT; and a light-emitting control unit 15, being controlled by the light-emitting control signal Emission and configured to input the second driving level V2 into the second electrode of the driving transistor DTFT after the threshold voltage Vth has been latched to the gate electrode of the driving transistor DTFT, so as to control the driving transistor DTFT to drive the light-emitting device D1 to emit light, and both the threshold voltage Vth of the driving transistor DTFT and the second driving level V2 are compensated by a gate-source voltage of the driving transistor DTFT.

In the implementation, the light-emitting device D1 may be an organic light-emitting diode (OLED).

In the implementation, if the driving transistor DTFT in the pixel circuit according to the embodiment of the present disclosure is a P-type transistor, the first driving level V1 is a low level VSS, and the second driving level V2 is a high level VDD; and if the driving transistor DTFT in the pixel circuit according to the embodiment of the present disclosure is an N-type transistor, the first driving level V1 is the high level VDD, and the second driving level V2 is a low level VSS. Optionally, the reset voltage is less than a sum of the reference voltage Vref and the threshold voltage Vth of the driving transistor DTFT, so as to facilitate the latching of the threshold voltage Vth of the driving transistor.

The transistors adopted in all embodiments of the present disclosure may be thin film transistors, field effect transistors, or other devices having similar characteristics. In embodiments of the present disclosure, except the gate electrode, one of the two electrodes of the transistor is a source electrode, and the other one is a drain electrode so as to differentiate these two electrodes. Furthermore, based on the characteristics of the transistors, the transistors may be categorized into N-type transistors and P-type transistors. In the driving circuit of this embodiment of the present disclosure, all transistors are P-type transistors, but the present disclosure is not limited thereto. It is obvious for those skilled in the art that the transistors may also be N-type transistors, which also falls within the protection scope of the present disclosure. In embodiments of the present disclosure, for an N-type transistor, the first electrode is the source electrode, and the second electrode is the drain electrode; and for a P-type transistor, the first electrode is the drain electrode, and the second electrode is the source electrode.

Figure 2:
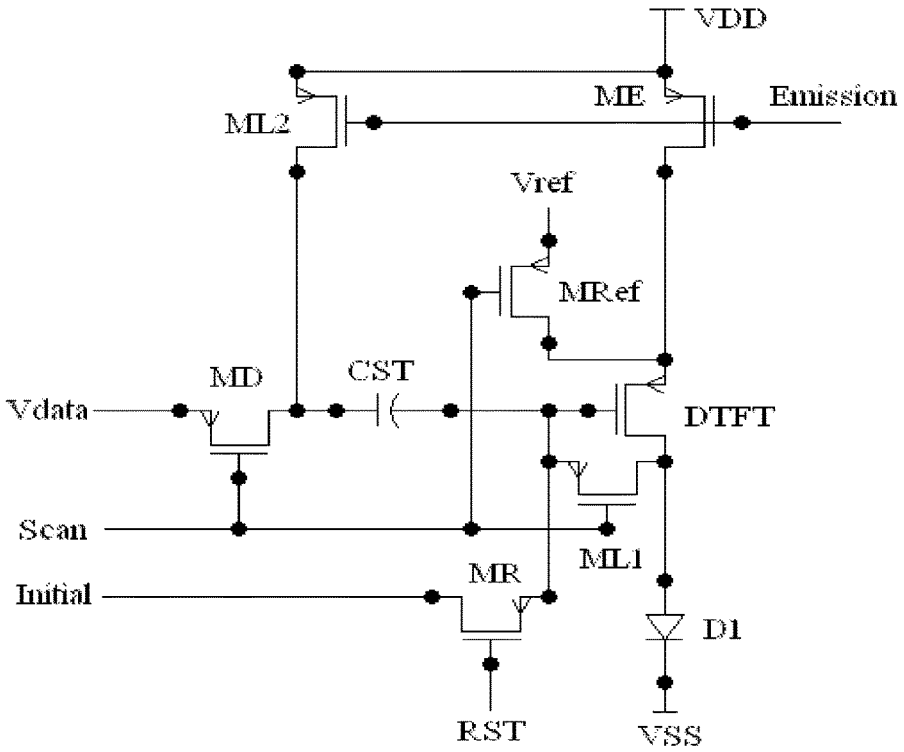
FIG. 2 is a circuit diagram of a pixel circuit according to an embodiment of the present disclosure.
Figure 3:
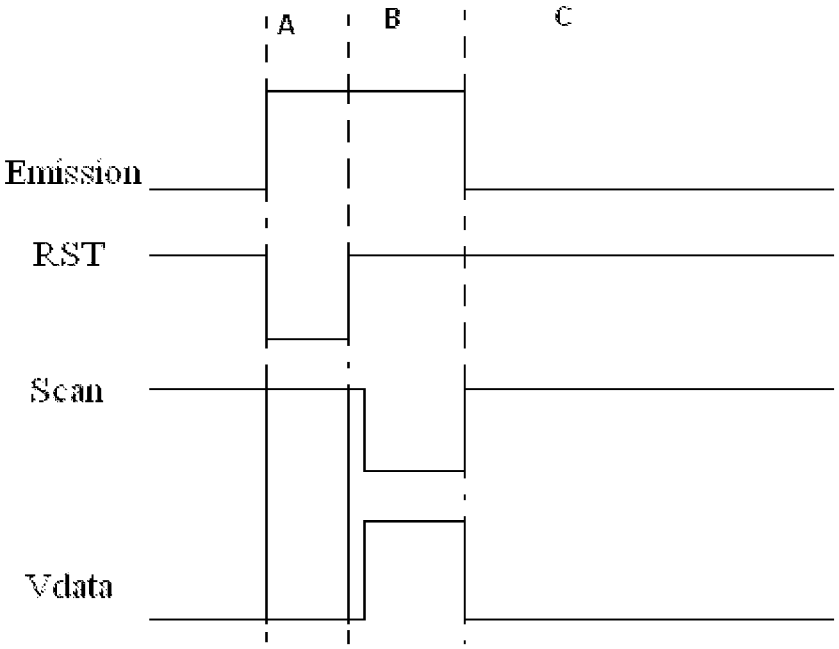
FIG. 3 is a workflow diagram of the pixel circuit according to an embodiment of the present disclosure.

In the pixel circuit of the specific embodiment of the present disclosure as illustrated in FIG. 2:

the light-emitting device D1 is an OLED, and the low level VSS is inputted into the cathode of the light-emitting device Dl;

the reset unit 11 includes:

a reset transistor MR, the reset control signal RST being inputted into a gate electrode of the reset transistor, the reset voltage Initial being inputted into a first electrode of the reset transistor, and a second electrode of the reset transistor being connected to the gate electrode of the driving transistor DTFT;

the writing unit 12 includes:

a data writing transistor MD, wherein the scanning signal Scan is inputted into a gate electrode of the data writing transistor, a first electrode of the data writing transistor is connected to the second end of the storage capacitor CST, and the data voltage Vdata is inputted into a second electrode of the data writing transistor; and a reference voltage writing transistor MRef, wherein the scanning signal Scan is inputted into a gate electrode of the reference voltage writing transistor, a first electrode of the reference voltage writing transistor is connected to the second electrode of the driving transistor DTFT, and the reference voltage Vref is inputted into a second electrode of the reference voltage writing transistor;

the voltage threshold latching unit 13 includes a threshold voltage latching transistor ML1, wherein the scanning signal Scan is inputted into a gate electrode of the threshold voltage latching transistor, a first electrode of the threshold voltage latching transistor is connected to the first electrode of the driving transistor DTFT, and a second electrode of the threshold voltage latching transistor is connected to the gate electrode of the driving transistor DTFT;

the driving level latching unit 14 includes a driving level latching transistor ML2, wherein the light-emitting control signal Emission is inputted into a gate electrode of the driving level latching transistor, a first electrode of the driving level latching transistor is connected to the second end of the storage capacitor CST, and the high level VDD is inputted into a second electrode of the driving level latching transistor;

the light-emitting control unit 15 includes a light-emitting control transistor ME, the light-emitting control signal Emission is inputted into a gate electrode of the light-emitting control transistor, a first electrode of the light-emitting control transistor is connected to the second electrode of the driving transistor DTFT, and the high level VDD is inputted into a second electrode of the light-emitting control transistor.

In the pixel circuit as illustrated in FIG. 2, all of the transistors are P-type transistors. If a transistor is the P-type transistor, the first electrode is the drain electrode, the second electrode is the source electrode, and the threshold voltage Vth of the P-type transistor is less than 0. The operation of the pixel circuit as illustrated in FIG. 2 is as follows.

In stage A (i.e. a resetting stage): the reset control signal RST is in the low level, both the light-emitting control signal Emission and the scanning signal Scan are in the high level, and the data voltage Vdata is in the low level; the reset transistor MR is turned on, both the scanning signal Scan and the light-emitting control signal Emission are in the high level, and all the other transistors are turned off; the charges remained at the first end of the storage capacitor CST from the last frame are discharged by the reset voltage Initial, while the potential at the first end of the storage capacitor CST is pulled down, so that the threshold voltage Vth of the driving transistor DTFT is completely written, wherein the reset voltage Initial is in the low level.

In stage B (i.e. a voltage writing and threshold voltage latching stage): the scanning signal Scan is in the low level, the light-emitting control signal Emission, the reference voltage Vref and the data voltage Vdata are all in the high level; the transistor Mref, the transistor MD and the transistor ML1 are all turned on, the data signal Vdata is written into the second end of the storage capacitor CST by turning on the transistor MD, the reference voltage Vref is written into the source electrode of the driving transistor DTFT by turning on the transistor MRef, and the driving transistor DTFT works as a diode by turning on ML1, so that the potential difference between the source electrode of the driving transistor DTFT and the drain electrode of the driving transistor DTFT becomes the threshold voltage of the driving transistor DTFT, i.e. Vth; as a result, the potential written into the first end of the storage capacitor CST becomes Ref1+Vth, Initial<Vref+Vth; furthermore, the potential of the reference voltage Vref is relatively low and facilitates the written in of Ref1+Vth; thus, the signal Vth is latched to the gate electrode of the driving transistor DTFT, while the potential of the second end of the storage capacitor CST and the potential of the first end of the storage capacitor CST are Vdata and Ref1+Vth respectively; wherein the reference voltage Vref is in the high level.

In stage C (i.e. a driving level latching and light emitting control stage): the light-emitting control signal Emission is in the low level, both the reference voltage Vref and the scanning signal Scan are in the high level, and the data voltage Vdata is in the low level; both the transistor ME and the transistor ML2 are turned on, the high level VDD is latched to the second end of the storage capacitor CST by turning on the transistor ML2, while the high level VDD is latched to the gate electrode of the driving transistor DTFT based on the conservation of the charges of the storage capacitor CST; thus, the potential of the second end of the storage capacitor CST and the potential of the first end of the storage capacitor CST are VDD and VDD−(Vdata−Vref−Vth) respectively; the transistor ME is turned on, the high level VDD is inputted into the source electrode of the driving transistor DTFT, so that the potential of the gate electrode of the driving transistor DTFT is VDD−(Vdata−Vref−Vth), the potential of the source electrode of the driving transistor DTFT is in the high level VDD, the driving transistor DTFT is in the saturation condition, and the value of the operating current Ids of the driving transistor DTFT in the saturation condition is as follows: $Ids=\frac{1}{2}\times K\times(Vgs-Vth)^2=\frac{1}{2}\times K\times(VDD-(Vdata-Vref-Vth)-VDD-Vth)^2=\frac{1}{2}\times K\times(Vdata-Vref)^2$, wherein Vgs indicates a gate-source voltage of the driving transistor DTFT, K=W/L×C×u, wherein W/L indicates a width-length ratio of the driving transistor DTFT, C indicates an interelectrode capacitance of the driving transistor DTFT, u indicates a migration ratio of the driving transistor DTFT, and K is relatively stable in the same structure and may be a constant; thus, the current passing through the organic light emitting diode connected to the drain electrode of the driving transistor DTFT is merely dependent on Vref and Vdata, and independent of Vth and VDD.

In the implementation, the value of the reference voltage Vref is set based on the value of the threshold voltage Vth, so that the threshold voltage Vref of the driving transistor may be promptly latched. For example, if the value of the threshold voltage Vth of the driving transistor is in a range from −2.5V to 3V, the value of the reference voltage Vref may be set to be around 1V, while it is necessary for the value of the reference voltage Vref to be matched to the value of the reset voltage Initial, so as to achieve a good compensation of the voltage threshold. The reset voltage Initial for implementing the reset should be less than the sum of the reference voltage Vref and the threshold voltage Vth of the driving transistor, so that the threshold voltage Vth of the driving transistor DTFT may be promptly written into the storage capacitor CST.

In this embodiment of the disclosure, a bottom emitting structure is adopted as an example, but the present disclosure is not limited thereto. It is obvious for those skilled in the art that a top emitting structure may be adopted, which also falls within the protection scope of the present disclosure. According to the embodiment of the present disclosure, a method for driving the pixel circuit includes:

inputting the reset voltage into the gate electrode of the driving transistor by the reset unit;

writing the data voltage into the second end of the storage capacitance and writing the reference voltage into the second electrode of the driving transistor by the writing unit; enabling the connection between the gate electrode of the driving transistor and the first electrode of the driving transistor by the threshold voltage latching unit, so as to latch the threshold voltage of the driving transistor to the gate electrode of the driving transistor; and latching the second driving level to the second end of the storage capacitor by the driving level latching unit; inputting the second driving level into the second electrode of the driving transistor by the light-emitting control unit, so as to control the driving transistor to drive the light-emitting device to emit light, and compensating the threshold voltage of the driving transistor and the second driving level by a gate-source voltage of the driving transistor.

According to the embodiments of the present disclosure, the display apparatus includes the above pixel circuit. The structure and operation of the pixel circuit included in the display apparatus are same as those in the above embodiment, which are omitted herein. The structures of other parts of the display apparatus are those parts in the prior arts, which are omitted herein. The display apparatus may be a household appliance, a communication device, an engineering facility, or any other product or component with a display function.

Optionally, the display apparatus may be an AMOLED display apparatus.

The above are only preferred embodiments of the present disclosure, the scope of the present disclosure is not limited thereto. All the modifications and alterations which can be easily thought by a person skilled in the art and within the technical scope of the present disclosure should fall in the protection scope of the present disclosure. Accordingly, the protection scope of the present disclosure should be defined by the claims.

What is claimed is:

1. A pixel circuit comprising a driving transistor, a storage capacitor and a light-emitting device, wherein the driving transistor is connected to a first end of the light-emitting device, wherein a first driving level is inputted into a second end of the light-emitting device, wherein a first end of the storage capacitor is connected to a gate electrode of the driving transistor and wherein the pixel circuit further comprises:

a reset unit configured to input a reset voltage into the gate electrode of the driving transistor to reset the driving transistor;

a writing unit configured to write a data voltage into a second end of the storage capacitor and write a reference voltage into a second electrode of the driving transistor after the driving transistor is reset, wherein the writing unit is configured to set the reference voltage based on a threshold voltage of the driving transistor and matched to the reset voltage, such that the reset voltage is less than a sum of the reference voltage and the threshold voltage of the driving transistor to write the threshold voltage of the driving transistor into the storage capacitor;

a threshold voltage latching unit configured to enable a connection between the gate electrode of the driving transistor and a first electrode of the driving transistor after the driving transistor is reset to latch the threshold voltage of the driving transistor to the gate electrode of the driving transistor;

a driving level latching unit configured to latch a second driving level to the second end of the storage capacitor after the threshold voltage of the driving transistor is latched to the gate electrode of the driving transistor; and a light-emitting control unit configured to input the second driving level into the second electrode of the driving transistor after the threshold voltage of the driving transistor is latched to the gate electrode of the driving transistor to (i) control the driving transistor to drive the light-emitting device to emit light, and (ii) compensate for the threshold voltage of the driving transistor and the second driving level via a gate-source voltage of the driving transistor, wherein the reset unit comprises a reset transistor and is controlled by a reset control signal, the reset control signal is inputted into a gate electrode of the reset transistor, both the writing unit and the threshold voltage latching unit are controlled by a scanning signal, both the driving level latching unit and the light-emitting control unit are controlled by a light-emitting control signal, the reset voltage is inputted into a first electrode of the reset transistor, a second electrode of the reset transistor is connected to the gate electrode of the driving transistor, while in a resetting stage, the reset control signal, the light-emitting control signal and the scanning signal are at a high level and the data voltage is at a low level, while in a writing and latching stage, the scanning signal is at the low level and the reset control signal, the light-emitting control signal, the reference voltage and the data voltage are at the high level, and while in a light-emitting control stage, the light-emitting control signal and the data voltage are at the low level, the reference voltage, the reset control signal, and the scanning signal are at the high level, and the high level is greater than the low level.

2. The pixel circuit according to claim 1, wherein the writing unit comprises:

a data writing transistor, wherein the scanning signal is inputted into a gate electrode of the data writing transistor, wherein a first electrode of the data writing transistor is connected to the second end of the storage capacitor, and wherein the data voltage is inputted into a second electrode of the data writing transistor; and a reference voltage writing transistor, wherein the scanning signal is inputted into a gate electrode of the reference voltage writing transistor, wherein a first electrode of the reference voltage writing transistor is connected to the second electrode of the driving transistor, wherein the reference voltage is inputted into a second electrode of the reference voltage writing transistor, and wherein the threshold voltage latching unit comprises a threshold voltage latching transistor, the scanning signal is inputted into a gate electrode of the threshold voltage latching transistor, a first electrode of the threshold voltage latching transistor is connected to the first electrode of the driving transistor, and a second electrode of the threshold voltage latching transistor is connected to the gate electrode of the driving transistor.

3. The pixel circuit according to claim 2, wherein:

the driving level latching unit comprises a driving level latching transistor, wherein the light-emitting control signal is inputted into a gate electrode of the driving level latching transistor, wherein a first electrode of the driving level latching transistor is connected to the second end of the storage capacitor, and wherein the second driving level is inputted into a second electrode of the driving level latching transistor; and the light-emitting control unit comprises a light-emitting control transistor, wherein the light-emitting control signal is inputted into a gate electrode of the light-emitting control transistor, wherein a first electrode of the light-emitting control transistor is connected to the second electrode of the driving transistor, and wherein the second driving level is inputted into a second electrode of the light-emitting control transistor.

4. A method for driving the pixel circuit of claim 1, the method comprising:

inputting the reset voltage into the gate electrode of the driving transistor via the reset unit;

writing the data voltage into the second end of the storage capacitor and writing the reference voltage into the second electrode of the driving transistor via the writing unit;

enabling the connection between the gate electrode of the driving transistor and the first electrode of the driving transistor via the threshold voltage latching unit to latch the threshold voltage of the driving transistor to the gate electrode of the driving transistor;

latching the second driving level to the second end of the storage capacitor via the driving level latching unit; and inputting the second driving level into the second electrode of the driving transistor via the light-emitting control unit to (i) control the driving transistor to drive the light-emitting device to emit light, and (ii) compensate for the threshold voltage of the driving transistor and the second driving level via the gate-source voltage of the driving transistor.

5. A display apparatus comprising the pixel circuit according to claim 1.

6. The display apparatus according to claim 5, wherein the display apparatus is an active matrix/organic light emitting diode (AMOLED) display apparatus.

7. The display apparatus according to claim 5, wherein the reset voltage is less than a sum of the reference voltage and the threshold voltage of the driving transistor.

8. The display apparatus according to claim 7, wherein the writing unit comprises:

a data writing transistor, wherein the scanning signal is inputted into a gate electrode of the data writing transistor, wherein a first electrode of the data writing transistor is connected to the second end of the storage capacitor, and wherein the data voltage is inputted into a second electrode of the data writing transistor; and a reference voltage writing transistor, wherein the scanning signal is inputted into a gate electrode of the reference voltage writing transistor, wherein a first electrode of the reference voltage writing transistor is connected to the second electrode of the driving transistor, wherein the reference voltage is inputted into a second electrode of the reference voltage writing transistor, and wherein the threshold voltage latching unit comprises a threshold voltage latching transistor, the scanning signal is inputted into a gate electrode of the threshold voltage latching transistor, a first electrode of the threshold voltage latching transistor is connected to the first electrode of the driving transistor, and a second electrode of the threshold voltage latching transistor is connected to the gate electrode of the driving transistor.

9. The display apparatus according to claim 8, wherein:

the driving level latching unit comprises a driving level latching transistor, wherein the light-emitting control signal is inputted into a gate electrode of the driving level latching transistor, wherein a first electrode of the driving level latching transistor is connected to the second end of the storage capacitor, and wherein the second driving level is inputted into a second electrode of the driving level latching transistor; and the light-emitting control unit comprises a light-emitting control transistor, wherein the light-emitting control signal is inputted into a gate electrode of the light-emitting control transistor, wherein a first electrode of the light-emitting control transistor is connected to the second electrode of the driving transistor, and wherein the second driving level is inputted into a second electrode of the light-emitting control transistor.

10. The pixel circuit according to claim 1, wherein the writing unit comprises:

a data writing transistor, wherein the scanning signal is inputted into a gate electrode of the data writing transistor, wherein a first electrode of the data writing transistor is connected to the second end of the storage capacitor, and wherein the data voltage is inputted into a second electrode of the data writing transistor; and a reference voltage writing transistor, wherein the scanning signal is inputted into a gate electrode of the reference voltage writing transistor, wherein a first electrode of the reference voltage writing transistor is connected to the second electrode of the driving transistor, wherein the reference voltage is inputted into a second electrode of the reference voltage writing transistor, and wherein the threshold voltage latching unit comprises a threshold voltage latching transistor, the scanning signal is inputted into a gate electrode of the threshold voltage latching transistor, a first electrode of the threshold voltage latching transistor is connected to the first electrode of the driving transistor, and a second electrode of the threshold voltage latching transistor is connected to the gate electrode of the driving transistor.

11. The pixel circuit according to claim 10, wherein:

the driving level latching unit comprises a driving level latching transistor, wherein the light-emitting control signal is inputted into a gate electrode of the driving level latching transistor, wherein a first electrode of the driving level latching transistor is connected to the second end of the storage capacitor, and wherein the second driving level is inputted into a second electrode of the driving level latching transistor; and the light-emitting control unit comprises a light-emitting control transistor, wherein the light-emitting control signal is inputted into a gate electrode of the light-emitting control transistor, wherein a first electrode of the light-emitting control transistor is connected to the second electrode of the driving transistor, and wherein the second driving level is inputted into a second electrode of the light-emitting control transistor.

12. The pixel circuit according to claim 1, wherein if the threshold voltage of the driving transistor is between −2.5V and 3V, then the writing unit sets the reference voltage to 1V.

* * * * *